United States Patent [19]

Britt et al.

[11] Patent Number: 4,566,782

[45] Date of Patent: Jan. 28, 1986

[54] VERY HIGH SPEED DUPLICATOR WITH FINISHING FUNCTION USING DUAL COPY SET TRANSPORTS

[75] Inventors: James E. Britt, Penfield; Kenneth W. Laskowski, Pittsford; Jeffrey L. Sisson, Macedon, all of N.Y.; Stephen A. Rinehart, Vienna, Va.

[73] Assignee: Xerox Corporation, Stamford, Conn.

[21] Appl. No.: 564,584

[22] Filed: Dec. 22, 1983

[51] Int. Cl.[4] ..... G03G 15/00; B65H 39/10

[52] U.S. Cl. ..... 355/14 SH; 355/3 SH; 355/24; 271/287; 270/53

[58] Field of Search ..... 355/3 R, 3 SH, 14 SH, 355/23, 24, 26, 14 R, 14 C, 14 E; 271/303, 305, 287; 270/53; 414/43, 52–54

[56] References Cited

U.S. PATENT DOCUMENTS

| | | | |
|---|---|---|---|
| 3,506,347 | 4/1970 | Carlson | 355/3 |
| 3,997,263 | 12/1976 | Stemmle | 271/303 X |
| 4,062,061 | 12/1977 | Batchelor et al. | 364/900 |
| 4,134,672 | 1/1979 | Burlew et al. | 355/14 |
| 4,158,500 | 6/1979 | DiFrancesco et al. | 355/14 |
| 4,176,945 | 12/1979 | Holzhauser et al. | 355/23 |
| 4,192,607 | 3/1980 | Hage | 355/50 |
| 4,229,101 | 10/1980 | Hamlin et al. | 355/77 |
| 4,264,183 | 4/1981 | Stoudt | 355/3 R |
| 4,278,344 | 7/1981 | Sahay | 355/14 SH |
| 4,328,919 | 5/1982 | Lawrence et al. | 227/155 |
| 4,361,393 | 11/1982 | Noto | 355/3 SH |
| 4,412,740 | 11/1983 | Buddendeck et al. | 355/3 SH X |
| 4,431,303 | 2/1984 | Hoffman | 355/3 SH |

OTHER PUBLICATIONS

Research Disclosure, Feb. 1980, No. 19015, p. 61.

Research Disclosure, Mar. 1983, No. 22733 and 22734, pp. 120–134.

*Primary Examiner*—R. L. Moses

*Assistant Examiner*—C. Romano

*Attorney, Agent, or Firm*—Bernard A. Chiama

[57] ABSTRACT

A document handling apparatus/copy sheet processor/finishing apparatus arranged as an integrated system to produce bound copy sheets at high speed but with minimum mechanical activity by double exposing each document sheet, producing successive copy sheets in accordance with the exposure, distributing the successive copy sheets alternately into receiving trays and utilizing a set transport for each of the trays to bring copy sets alternately to a single point binding device.

12 Claims, 6 Drawing Figures

11
12
13
14
15
18
19
25
26
27
28
29
30
31
32
33
34
36
37
39
40
42
50
52
53
54
55
56
P 11
12
P
200
75
50
76
82
80
83
90
87
85
91
84
79
86
82
93
13
77
94
92

VERY HIGH SPEED DUPLICATOR WITH FINISHING FUNCTION USING DUAL COPY SET TRANSPORTS

This invention relates to an improved copying/finishing system by incorporating a novel sequencing arrangement of document handling and finishing to affect very high speed copy set production by way of high productivity.

With the advent of higher speed and more sophisticated copy producing machines, printing presses, and the like, considerations as to how the mass of copies generated can best and most effectively be handled, has assumed increasing importance. One way has been to provide a reproduction system with an input device in the form of a recirculating document handling apparatus. In this system, a document sheet is removed from a collated set of document sheets, placed on an exposure platen for exposure at the rate of one exposure for each document sheet, and returned to the top of the set in the document handling apparatus until the set of document sheets has been completely circulated through the apparatus, and a completed, collated copy set has been produced. The set of document sheets is then recycled for the reproduction of a second copy set, and so on. After each copy set is produced and collected at a collection station, an attaching device such as a stapler or stitcher may be activated to bind the set. In more recent considerations in copy systems has been the use of adhesive binders for finishing whereby collated sets are bound along one edge by an adhesive material. Therefore, for the description below of the art and the present invention, it will be understood that the generic term "finishing" will include such copy sheet attachment or binding as produced by stapling, stitching and adhesive binding.

Generally, these systems are of the pre-collation type wherein the document sheets are loaded in collated order into the document handling apparatus prior to commencement of a reproduction run. The output for the reproduction machine will likewise be precollated in sets corresponding to the sequenced numbered document set in the document handling apparatus. The copy sheets are collected in collated sets, one set at a time at a single collection point as they are sequentially produced so that binding may be effected without the interaction of additional devices. Such systems are described in U.S. Pat. No. 4,134,672.

One of the disadvantages of the pre-collation type systems having continuous document recirculation to produce a bound copy set at a time is that present day document handling apparatus have lower reliability when handling document sheets at very high speeds such as, at the rate of 120 or more copy impressions per minute for which their host copiers are adapted. Document sheet handling at these rates could result in physical damage after a number of recirculations. Further, the compilation of each copy set and eventual stapling or stitching, would require complex mechanisms which increases the risk of unscheduled maintenance. In addition, generally, in providing for the finishing step such as stapling, stitching, or adhesive binding one or more machine pitches per set may be lost thereby reducing productivity for the system. For example, the time period for removing a document sheet from the exposure platen by the document handling apparatus and to place another sheet thereon and in proper registration, or in manipulations to copy both sides of a document sheet sequentially, may be such that an entire machine pitch, or copy cycle may be lost. Consequently, either a slower copy processor speed must be employed or only a lesser number of machine pitches can be utilized to produce a copy sheet. In other words, in commerical machines presently in use, the maximum speeds for reliable copy processing is higher than the maximum speed of reliable document handling in a recirculating type apparatus and in finishing collated copy sets.

In a so called "immediate" duplex system such as that shown in U.S. Pat. Nos. 4,158,500; 4,176,945; and 4,192,607, duplex document sheets are copied on one side and then are immediately moved from the platen to be turned over (or inverted) and immediately returned to the platen for copying the opposite side of each document after copying the first side. This must be done for each duplex document sheet in each circulation of a document set to provide precollated output copies. This system requires very rapid handling of each document sheet in a small arcuate path within a short time period corresponding to one machine copy cycle or pitch for the copier. If this cannot be done, then at least one pitch of the copier must be skipped for each said duplex document sheet handling step, i.e. the copier controller is programmed to copy one side of each document sheet in one step in one pitch, skip a pitch while the document sheet is being inverted and returned, copy the other side of the document sheet with the next pitch, copy the first side of the next document sheet, skip a pitch while inverting this second document sheet, copy the opposite side of that second document sheet, and so on. It may be seen that this undesirably reduces the effective copy rate of the copier by one third for duplex document sheets to duplex copy sheets mode of operation. Additional pitches are lost if each document sheet, after side two is exposed, is re-inverted before returned to the stack of document sheets. Such operation also requires a different copying sequence for the machine programmer for duplex document sheets than for simplex document sheets with different actuations of the inner document or pitch fadeout lamps or the like to prevent contamination of the photoreceptor in the skipped pitches between document images.

Very high speed copy set production may be achieved in a system of the post-collation type wherein each document sheet is exposed for a relatively high number of times, for example, ten or twelve times before the next document sheet is similarly exposed, and so on. A sorter array having a number of bins equal to the number of exposures collate the collected sets and a set transport is arranged to remove each collected set from the bins and to transport them to a stapler device. A typical example of a post-collation type duplicator system is disclosed in U.S. Pat. No. 4,444,491. These systems are rather cumbersome, requiring many additional hardware components, space and attention, and not readily efficient for a small number of copy sets.

In order to achieve higher rates of production of finished copy sets using a recirculating document handler in a very high speed copier, and the finishing collated copy sets, the present invention, in one aspect, contemplates the concept of utilizing pre-collation with dual exposures per document sheet side capability. The inventive arrangement utilizes recirculating document handling wherein two images are produced for each side of a document sheet, say for example, of page one of a multi-page document, before a successive document sheet, or perhaps page two of the document sheet if the duplex mode has been selected, is likewise imaged. This sequencing of producing dual images in turn may be repeated additional times if a larger number of copy sets are to be reproduced. In this aspect of the invention, the mechanical movements involved in document handling are reduced and yet maximum throughput at very high speeds can be achieved.

In the other aspect of the invention, copy sheets produced in accordance with the above imaging procedure, are collected in a pair of collecting trays by means of a sheet transport and one or more diverter gates(s) arranged to alternately deliver sheets to each of the trays.

At the instant a first copy set is completed, such as when the last copy sheet of the document is delivered to its designated tray, the copy set is removed from the collecting tray by means of a set transport positioned on the end of the tray opposite that to which the sheets are delivered. This action occurs even as the last copy sheet is being delivered to the other tray. For binding purposes, the set transport conveys the copy set to a single finishing station whereat a finishing device such as one or more stitchers, staplers or adhesive binders positioned adjacent the set transport activated to apply one or more staples to each completed set, or to effect adhesive edge binding. At the instant the second copy set is completed, a second set transport is actuated to remove this set and to convey the same to either the same or to a second stitcher, stapler, or adhesive binder. This action occurs as the first copy sheet of still another copy set is being delivered to the first tray. In this arrangement, copy sets are brought to a single point for binding by two set transports working in conjunction with two collating bins.

In its total system, therefore, the present invention takes advantage of some of the best features of both precollation and post-collation in a mutually complimentary manner. By the same token, the disadvantages specific to each of these forms of document handling/finishing has been minimized or eliminated.

Except for the modification described herein in accordance with the present invention, the same is particularly adapted for incorporation into present day machines on the market, such as the Xerox copying machine designated the 1075 ® Copier and the duplication machines labeled the 9400 ® Duplicator and the 9500 ® Duplicator marketed by Xerox Corporation of Stamford, Conn. Such machines are disclosed in U.S. Pat. Nos. 4,278,344 and 4,062,061, respectively, and are herein incorporated by reference. These machines utilize full frame, flash exposure of a document sheet placed on an exposure platen. However, any other copying machine may be utilized which employs full frame, flash exposure on a photoreceptor which has a flash exposure image plane.

The preferred embodiment of the present invention contemplates the cooperative use of a recirculating type document handling apparatus which provides for exposure of each side of a document sheet twice while on the platen and transports that sheet back onto a document stack while feeding a succeeding sheet from the bottom of the stack, onto the platen, and so on.

In the preferred embodiment of the invention, the form of document handling aparatus is used which will provide simplex to simplex, simplex to duplex, and duplex to duplex modes of copying. A copy sheet processor of the type utilized in the 9500 ® Duplicator, see U.S. Pat. No. 4,062,061, cited above, may be utilized, being of the type which, for duplex to duplex copying, utilizes a duplex tray, as a buffer, to receive multiple copies of copy sheets having images on one side and to re-feed these sheets back through the processor to receive images on the other sides of the copy sheets. A companion patent application, Ser. No. 564,585, commonly assigned and filed on even date herewith, utilizes immediate duplex copying in cooperation with dual flash exposure of document sheets, such arrangement being a modification of the more general invention disclosed herein.

While the above two embodiments are preferred for use with the present invention, still other embodiments may be devised as will be discussed below.

The present invention also includes a finishing arrangement for binding copy sheets received in succession at a sheet collecting device, comprising a pair of collecting trays each with an inlet on one side for receiving individual sheets from a sheet transport. The transport conveys each copy sheet to the trays in succession at a fixed loading position and a diverter gate oscillates between the trays for directing the sheets alternately. A pivotal set transport means is also provided for each tray for removing each completed copy set from the trays alternately at an unloading position on the other side of the trays from the sheet receiving loading position. When a tray receives the last sheet of a set being produced, the set transport associated therewith is activated to grip an edge of the set, to remove the same from the tray, and to transport the same to a binding device. Immediately after this operation, the other set transport performs the same operation on the other tray which at this time has received the last sheet of this set. Simultaneous with this operation, the first tray is receiving the first sheet.

A dual flash exposure scheme for a copier is broadly disclosed in the Research Bulletin No. 19015, Page 61, dated February 1980. This disclosure is limited to only the concept of dual flash exposure and a dual collecting tray arrangement. The scheme is not applied to duplex document handling nor to duplex copy sheet production in a single pass copying system. There is a complete lack of implementation as to the accomplishment of any facet of the broad concept especially in the handling of copy sheets during processing. No mention is made as to the handling of collected copy sets nor of effecting binding without losing the effect of dual flash exposure.

It is therefore the principal object of the present invention to produce bound sets or stacks of copies of a multi-page document at the highest speed possible for a reproduction machine.

It is a further object of the present invention to maintain full productivity in a reproduction/finishing system by minimizing or eliminating those machine copy cycle pitches which would be wasted during some machine operating steps such as document handling and copy set transporting.

It is another object of the present invention to minimize the number of moving parts in a document handling apparatus and finishing station and to reduce the number of movements usually incurred during the operation thereof.

While the present invention is disclosed in combination with a reproduction machine of the electrostatographic type, it will be understood that the disclosed precollating finishing system may be combined with other printing apparatus or machines which merely sort, collect and/or effect the movement of informational items such as sheets or cards.

Other objects and advantages will be apparent from the ensuing description and drawings wherein.

Figure 1:
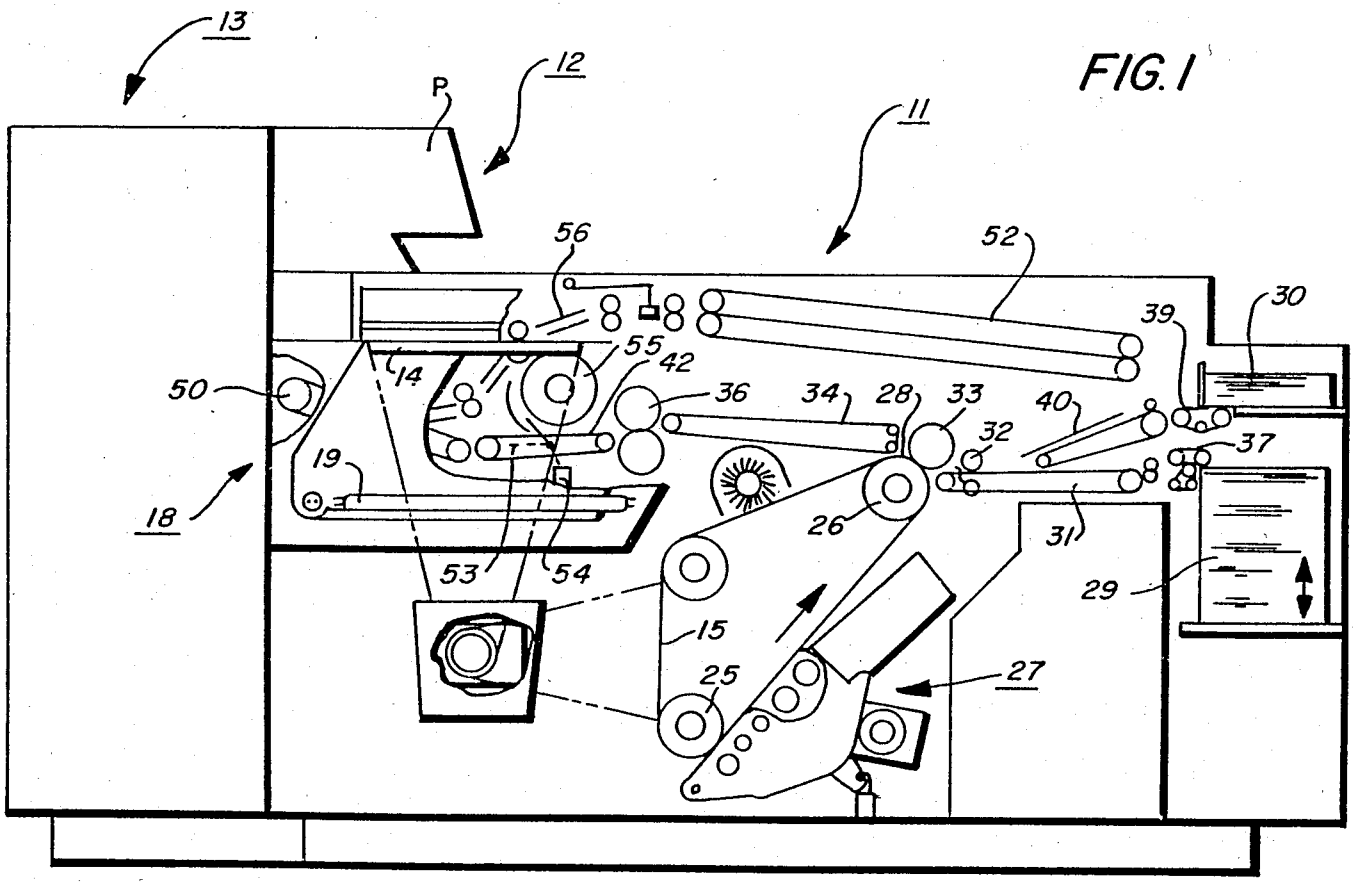
FIG. 1 is a schematic illustration of a configuration of an electrostatographic printing/finishing system employing the present invention.

For a general understanding of a reproduction machine with which the present invention may be incorporated, reference is made to FIG. 1 for the preferred embodiment of the invention wherein some components of a typical electrostatographic printing system are illustrated. The printing system shown is of the xerographic type as one including a xerographic processor 11, and a recirculating type document handling apparatus 12. In this embodiment, the processor 11 is, except for modifications to be described hereinafter, the same as the processor in the commercial embodiment of the Xerox 9500® Duplicator, which utilizes flash, full frame exposure for very high speed production. Document sheet exposure, image processing and copy sheet transport/handling are under control by a machine programmer and are effected in timed sequence, and in accordance with the program an operator has preset in the machine. Further details in this regard are not necessary since the Xerox 9500® Duplicator operates in this manner and is well known.

Except for modifications to be described below, details of the timing relationships, the programmer, and related structure and events are described in U.S. Pat. Nos. 3,790,270; 3,796,486; and 3,917,396, commonly assigned and which are incorporated herein by reference. A document handling apparatus which may be used in the present invention is described in U.S. Pat. No. 4,229,101 commonly assigned and which is incorporated herein by reference. The distinctions in the document handling apparatus contemplated in the present invention from that disclosed in this patent is that in the present invention, dual flash exposure is provided for each side of a document sheet. It will be understood that other types of xerographic processor which has full frame, flash exposure and any recirculating or other type document handling apparatus may be utilized. Operating in conjunction with the processor 11 and apparatus 12 is a finishing station 13 and thereby forms the reproduction system shown in FIG. 1.

The system comprising the processor 11, the document handling apparatus 12, and the finishing station 13 (see FIG. 3), is under control of a programmer P which permits an operator various options: to turn the entire system ON or OFF; to program the reproduction system for a desired number of reproductions to be made of each original document sheet or set; to select whether simplex or duplex copies are to be made; to select a desired output arrangement, that is, sets mode or stacks mode, stapled or unstapled; to select one of a plurality of paper trays; to condition the machine for the type of document, that is, whether one sided or two sided, to select a copy size reduction mode, copy quality parameters, specialty features, and other desirable functions. The programmer P also includes a controller which provides all operational timing and synchronization between the processor 11 and all of its xerographic processing functions, and system control functions, the automatic events to be described hereinafter. The controller may include any suitable microprocessor having a CPU and the appropriate machine clock, but preferably the microprocessor is one similar to the Intel 8080 family of microprocessors manufactured by the Intel Corporation, Santa Clara, Calif., and having sufficient ROM and RAM for all of the necessary functions in the reproduction system.

The processor 11 includes an exposure station at which a document sheet to be reproduced is positioned on a glass exposure platen 14 for projection onto a photosensitive surface in the form of a xerographic belt 15. The set of individual document sheets are selectively transported by the document handling apparatus 12 one document sheet at a time to the platen 14 for exposure. After dual exposure of each document sheet is made, the same is returned to the top of the set or stack for simplex mode of copying or is turned over for exposure on the back side and returned to the top of the set until the entire set has been copied, whereupon the procedure starts again for a preset number of times depending upon the number of copy sets to be produced.

Imaging light rays from each of the document sheets are flash illuminated by an illumination system 18 having lamps 19 connected to a suitable flashing circuit (not shown) under control by the programmer P in timed sequence, and in accordance with the program the operator has preset in the machine. Further details in this regard are not necessary since the well known Xerox 9500® reproduction machine operates in this manner, and such arrangement is disclosed in U.S. Pat. No. 4,062,061. The xerographic belt 15 is mounted for movement around three parallel arranged rollers 24, 25, 26 suitably mounted in the processor 11. The belt is continuously driven by a suitable motor (not shown) and at an appropriate speed. The exposure of the belt to the imaging light rays from a document sheet discharges the photoconductive layer in the area struck by light whereby there remains on the belt an electrostatic latent image corresponding to the light image projected from the document. As the belt continues its movement, the electrostatic latent image passes a developing station at which there is positioned a developer apparatus 27 for developing the electrostatic latent image.

After development, the powdered image is moved to an image transfer station 28 where the developed image is transferred to a support surface, normally a sheet of copy paper, brought from a main or auxiliary paper tray 29, 30, respectively, as will appear. Each sheet is conveyed to the transfer station by a conveyor 31 which cooperates with sheet preregistration pinch rollers 32. These rollers are in driving contact to produce a nip whereat each sheet is preregistered prior to reaching the transfer station 28. Further details of the timing relationships and related structure and events are described in the above referred to U.S. Pat. Nos. 3,790,270; 3,796,486; 3,917,396; and 4,062,061.

Each sheet is moved in synchronism with the movement of the belt 15, and passes between a transfer roller 33 and the belt 15 at the transfer station. After transfer, the sheet of paper is stripped off the belt 15 and transported by a vacuum conveyor 34, having one or more perforated belts in an inverted condition to a fusing station where a fuser device 36 is positioned to receive the sheet of paper for fusing the powder thereon. After fusing, the sheet is transported to the finishing station 13.

As previously stated, copy sheets are supplied from either the main paper tray 29 or the auxiliary tray 30. Main paper tray 29 may include a suitable elevator type base on which a supply of sheets rest, the base being supported for automatic up and down movement by suitable means (not shown). Such movement being arranged to maintain a top-feeding sheet feed mechanism 37 in operative contact with the topmost one of the sheets on a stack arranged on a suitable elevator. The sheet feed 37 is operated intermittently in timed relationship to spacing of images on the photoreceptor belt 15 under control of the programmer P, and serves to advance the topmost sheet from the supply stack 29 to the main paper supply transport 31.

The auxiliary tray 30, in the exemplary arrangement shown, is arranged above main tray 29 and includes an air floatation baseplate upon which a supply of sheets may be placed. A bottom-feeding, sheet feed mechanism 39 is positioned for feeding sheets from the bottom of the stack of sheets thereon. Assisting in this feeding operation is an air floatation system, not shown, which substantially reduces the weight of the stack to permit easy withdrawal of sheets from the bottom. The sheet feed mechanism 39, which is intermittently driven in the same manner as the main tray feed mechanism 37, advances one sheet at a time to an auxiliary paper supply transport 40. The transport 40 is suitably driven by a drive system (not shown) and is disposed to discharge sheets drawn from auxiliary tray 30 onto the operating run of main supply transport 31. The sheets from auxiliary tray 30 are thereafter directed to the preregistration rollers 32.

During operation, if the reproduction system is preset for simplex copying, copy sheets leaving the processor 11 after exiting the transfer station 28, are conveyed directly to the fuser apparatus 36 and to the finishing station 13 by way of a post fuser transport 42 and an exit transport 50. If the system is preset for duplex copying, copy sheets, when on the post transport 42 are directed to a return transport 52. A deflector 53 when extended by a solenoid 54 directs sheets on the transport 42 onto a conveyor roller 54 and into a chute 55 leading to the return transport 52.

The duplex return transports 52 carry copy sheets back to the auxiliary tray 30 from whence they are re-fed by the feeder 39 and by way of the transports 40, 31 to the transfer nip to receive toner images on the back side of the copy sheet during the duplex mode of operation. Further details of the processor 11 and its controls will be found in the above referred to U.S. Pat. No. 4,062,061 and the patents cited therein, all of which are incorporated by reference herein.

The document handling apparatus 12 is of the recirculating document type and includes a wide light-reflecting belt 60 for transporting document sheets from a stack on a document tray 61 after the sheet has been individually separated from the bottom of the stack by a separating belt 62/retract pad device 63. The registration of each document sheet on the platen may be conventionally provided by a solenoid operated registration gate 64 at the downstream edge of the platen, connected to the machine programmer.

The belt 60 is mounted between a large roller 65 at the downstream or output side of the platen 14 for the processor 11 and a smaller roller 66 at the input side of the platen. Driving of the document sheet around the roller 65 to provide the initial document inversion is accomplished by nipping the document sheet against the outer surface of the belt 60 and a plurality of guide rollers 67. Further transporting of the document sheet carries the same to a juncture from which two separate return paths are provided to the document stack on the tray 61. There is a first or simplex return path provided by a simplex belt transport 70 over to and around a second inverting roller 71 from which document sheets are ejected into the tray 61 from above and at the rear of that tray. Alternately, there is a separate second or duplex document sheet recirculating return path provided by a second or duplex document transport directly from the first inverting roller 65 into the front end of the tray 61.

The selection of one of these paths is made by a simplex/duplex switching arrangement including a deflector 73 which pivots between the illustrated solid line position for simplex operation and the dashed line position for duplex operation. In the simplex position, document sheets exiting the roller 65/guides 67 are directed by the deflector 73 into the simplex transport 70, while in the duplex position, document sheets are directed into the duplex transport 72.

It may be seen that by selecting between these two positions of the deflector 73 that the simplex transport 70 and its integral second inverting roller 71 may be readily automatically switched in or out of the document recirculation path, in coordination with the recirculation of a document set, to provide selectively in each circulation either a single inversion of each document sheet (by-passing the second inverter) or two inversions in series for each document. The switching of the deflector 73 may be accomplished by a conventional solenoid electrically connected to the machine programmer.

With the single inversion (the duplex path 72) selected, a document sheet which is initially face down in the tray 61 will be returned face up after it is exposed on each circulation. Thus, by the end of the circulation, all the document sheets in the circulated set will all have been already inverted during the copying circulation itself. With the circulation path with both inversions (the simplex path 70) selected, each document sheet is returned to the tray in the same orientation it had before being circulated.

The respective inverting rollers 65 and 71 provide these document inversions, and also a turnaround or change in document sheet movement direction, by each rotating the document sheets approximately one-half way around the outsides of each roller.

When the recirculated document sheets are returned to the document tray 61 in their original orientation, the same sides of the document sheets will be copied in the subsequent recirculations of the document set. However, by returning the recirculated document sheet to the document tray in inverted orientation, the opposite sides of duplex document sheets may be immediately copied in the subsequent recirculation of the document set. That is, the even numbered pages of duplex document sheets may be exposed for copying in one circulation, the odd numbered pages exposed for copying on the next circulation, the even numbered pages exposed for copying on the next circulation, then the odd numbered pages exposed for copying again on the next circulation, etc.

Figure 2:
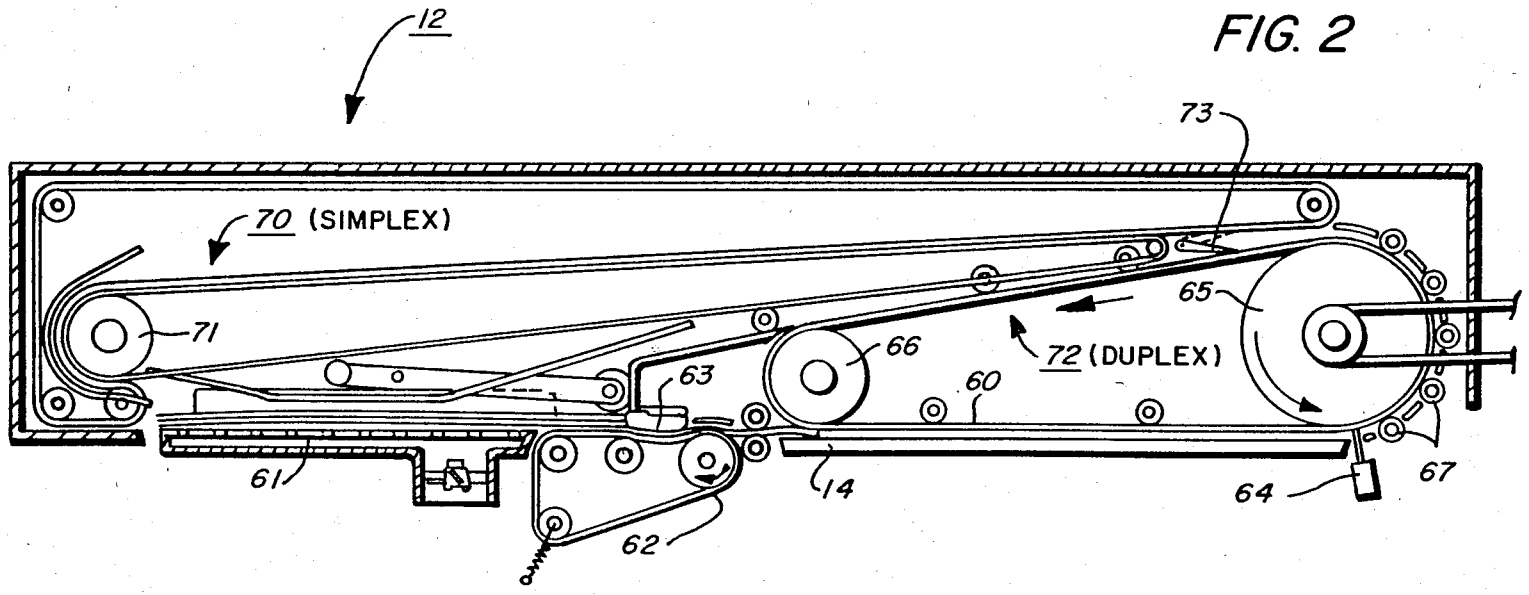
FIG. 2 is an elevational view, partly in section, of the preferred embodiment of a document handling apparatus utilized in the system of FIG. 1.

In the embodiment of the invention utilizing the apparatus 12 of FIG. 2, no external inverting system or path is required. Both the simplex and duplex recirculation paths are continuous and uni-directional, i.e. the movement of the circulated document sheets does not have to be stopped or reversed at any time, even during the document inversions except for registration. That is highly advantageous since it reduces the number of machine pitches, even for registration purposes.

The two document sheet recirculation paths from the exposure station back to the document tray are different and distinct from each other and from the common document sheet recirculation path from the document tray to the exposure station. Thus, one document sheet may be being fed from the tray to the exposure station while another document sheet (previously exposed) is being fed from the exposure station back into the tray through either the simplex or duplex document sheet paths. While on the exposure platen 14, each side of a document sheet to be exposed is double exposed before removal of the sheet from the platen. For either simplex or duplex modes of operation, in accordance with the present invention, two flash exposures are made for the side of a document sheet while on the platen.

Figure 3:
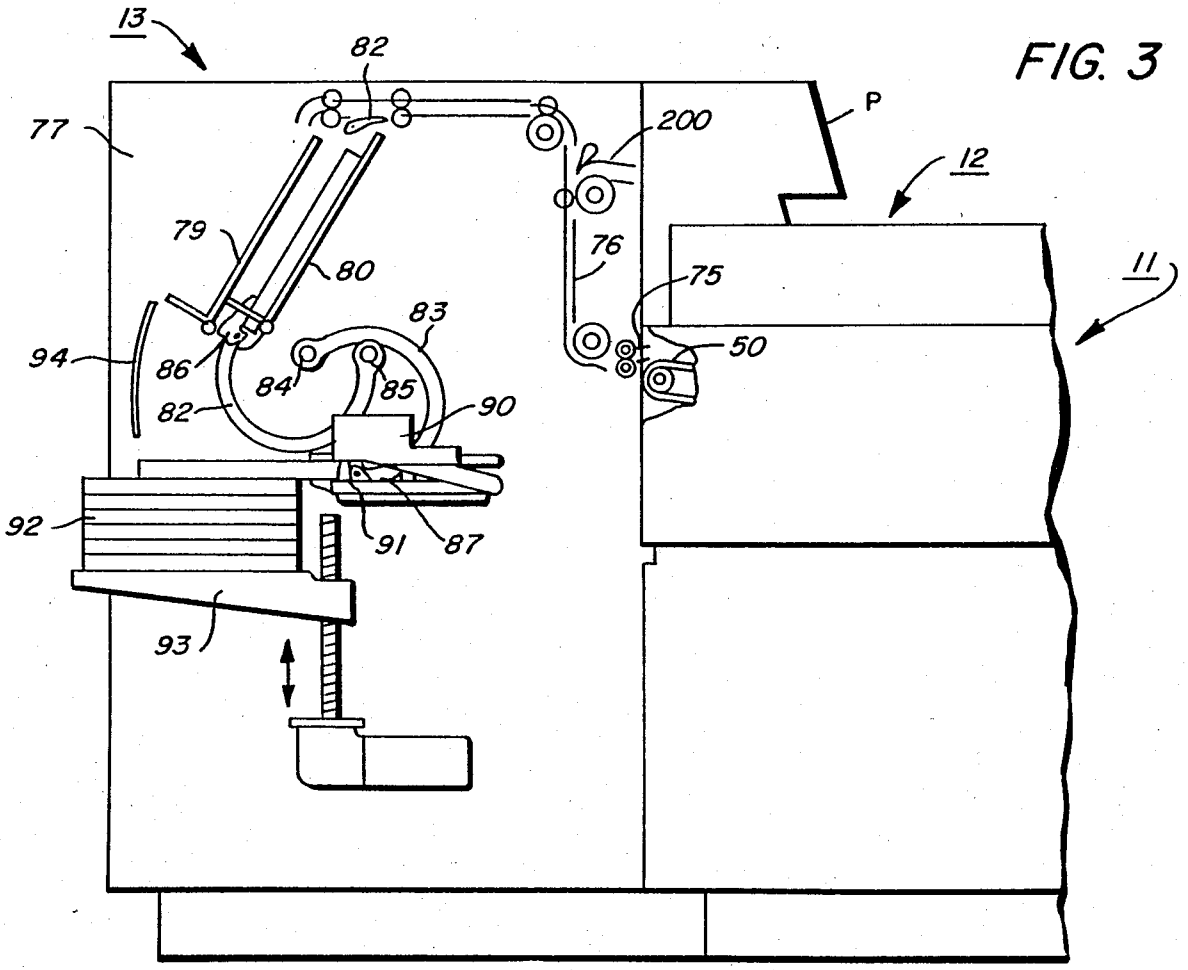
FIG. 3 is a schematic illustration of a finishing station utilized in the present invention.

As shown in FIG. 3, the finishing station 13 is arranged on one side of the processor 11 whereat copy sheets, either simplex or duplex are exited through a slot 75. A suitable transport 76 carries the sheets vertically upward and then horizontally to a two bin compiler system 77 comprising bins 79, 80 and a solenoid operated deflector 82 pivotal in one direction to direct a copy sheet in one bin and in the other direction. The bins 79, 80 are positioned at approximately 30° to the vertical and as the copy sheets are collected therein, they become registered by means of the bottom wall of the bins. Suitable joggers or scuffers (not shown) may be incorporated in each of the bins to insure good quality corner registration.

A pivotal set transport 82 is in cooperative relationship with the bin 79 and a second pivotal set transport 83 is in cooperative relationship with the bin 80. The set transports 82, 83 are pivoted at pivot points 84, 85, respectively, and include power actuated clamps 86, 87 which serve to grip the lower registered edge of a complete copy set from their respectively associated bin and to transport the set to a finishing apparatus 90. The apparatus includes a pair of aligned staplers or stitcher assemblies arranged to apply one or two staples selectively along the gripped edge. Each of the set transports directs the gripped edge into the clamping device for the stapler or stitcher assemblies of the apparatus 90 whereat the edge is clamped, a staple or two are driven thereinto and clinching is performed to complete the finishing action in the conventional manner.

The apparatus 90 may include a kicker mechanism 91 arranged to provide a short horizontal impulse to a bound copy set to move the same to and upon a stack 92 of finished copy sets being accumulated upon an elevator 93. A curved guide plate 94 is arranged above the stack to assist in guiding the trailing edge of each copy set being removed by a set transport and as the copy set is carried to the stack after a finishing operation.

While the foregoing description for the finishing of copy sets has been directed to staplers and stitchers, the present invention is not restricted thereto. The term finishing is used herein in its broad sense to include other forms of binding such as adhesive binding. In accordance therewith, the finishing apparatus 90 may also be in the form of an adhesive binder adapted to apply adhesive to the edge of a copy set.

As each of the two copy sheets, each bearing images on one or both sides after simplex or duplex document sheet double exposure and corresponding simplex or duplex copying as aforesaid, the sheets are conveyed by the transport 50, through the exit slot 75 and into the bins 79, 80 alternately. The deflector 82 is under control of the machine Programmer to be actuated alternately so that the bins 79 receives the first copy sheet corresponding to the bottom document sheet in the tray 61 and the bin 80 receives the second sheet in the same orientation. In simplex copying, the first copy sheet will have its image side facing downwardly, and in duplex copying, the odd numbered side will face upwardly so that page 1 of a completed copy set faces upwardly. For the next set of two copy sheets produced in the duplex mode, the sheets will be placed alternately upon the preceding sheets in the bins with the odd page number on the upper side of the sheets, and so on. Assuming that the document in the apparatus 12 consists of five document sheets with each having both sides to be copied so that there are 10 numbered pages of to-be-copied data, the corresponding sheets will be collected in the bins 79, 80 starting with the surface having page 10 facing the bottom of the bins thereby leaving page 9 as the top surface, with page 8 as the lower surface of the second copy sheet, thereby leaving page 7 as the top surface of the second sheet, and so on.

Upon completion of the copy set in bit 79, the driving mechanism for the set transport 83 is immediately actuated even before the last sheet is fully positioned in bin 80. The copy set is transported to the apparatus 90 for finishing thereof and placed upon the collected set stack. During this action, the set transport 82 is actuated immediately after the last sheet enters the bin 80 and the copy set therein is transported to the finishing apparatus 90 for binding as was the first set. During this latter operation by the set transport 82, the bin 79 is receiving the first copy sheet of the third copy set to be produced. After the transport 82 has removed the copy set in the bin 80, the latter immediately receives the second copy sheet of the third copy set, and so on, the alternate operation of the set transports and the transporting of copy sheets to the bins are timed so that there is no loss of machine cycles and copy sheets are allowed to flow to the station 13 in a steady stream. The concept of the second set clamping and unloading and thereby holding or "buffering" a copy set while the first copy set is being finished in effect "buys time" to accomplishing finishing in two or three cycles.

By the utilization of two alternating set transports wherein each is operated in the time span of two or three machine cycles or pitches instead of for every machine cycle, very high speed copy set production can be maintained without subjecting mechanical parts to equivalent high speed movement which can result in increased wear and tear and jam incidences. The most significant contribution of the dual flash concept for which the present invention is embodied is to reduce document handling stress. In the example above, assuming 10 copy sets were programmed, each of the bins 79, 80 would have collected five sets and upon production of 10 completed and finished copy sets, all arranged in the stack 92, the system will revert to standby condition, as conventionally known.

Figure 4:
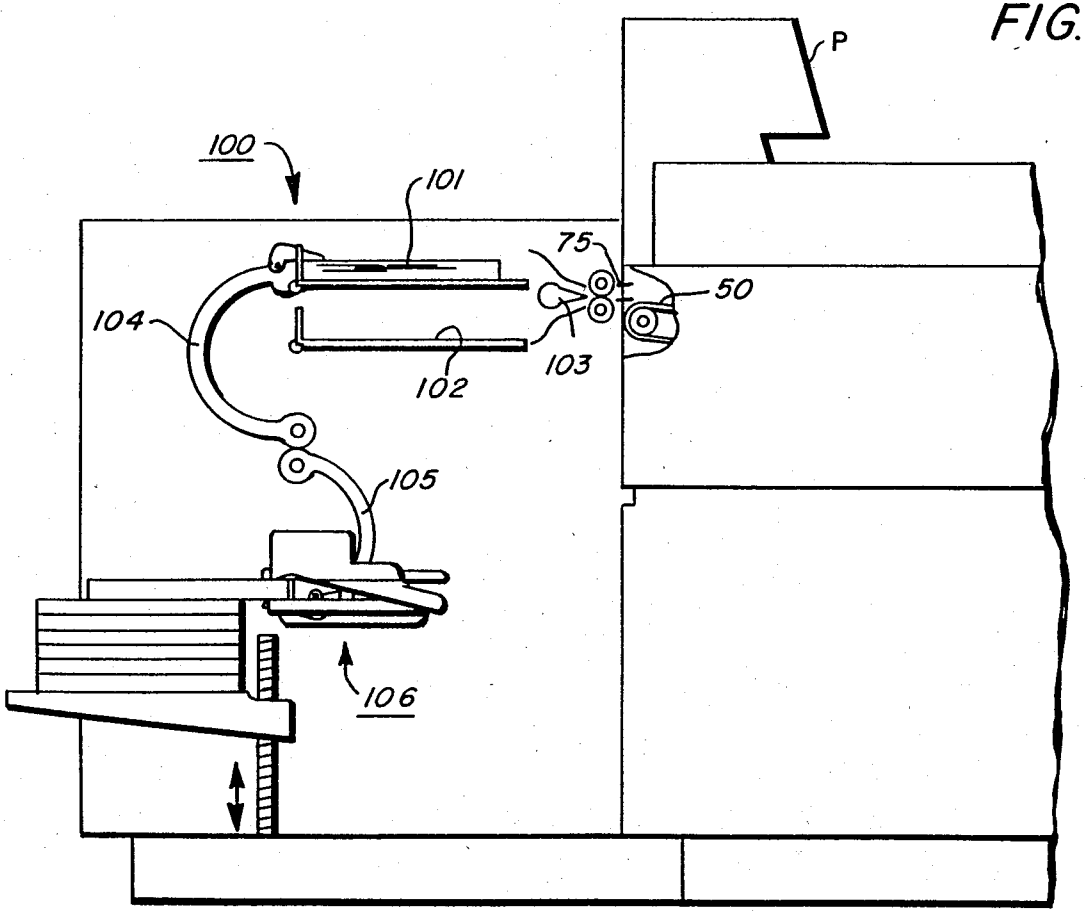
FIG. 4 is a schematic illustration of another embodiment of a finishing station.

Another embodiment of the finishing station to which the present invention may be applied is illustrated in FIG. 4. In this embodiment, the finishing station 100 comprises two collating or collecting bins 101, 102 arranged in horizontal planes, one above the other. A single deflector 103 is utilized, under control of the machine controller, to direct copy sheets alternately into the bins as each set of two identical copy sheets exit the slot 75. Suitable scuffers may be employed in each of the bins to effect corner registration. A pair of set transports 104, 105 are pivotally mounted in the station and a two stapler or stitcher assembly 106 is associated therewith. These devices all perform in the manner and the sequence described above for the embodiment of FIG. 3. Instead of the assembly 106, an adhesive binder may be employed for effecting finishing of the copy sets.

In the operation of the embodiment of FIGS. 2 and 3, document sheets are fed from the stack on the document tray 61 to the exposure platen 14 for the processor 11. It is assumed the document sheets are in N-1 order, that is, page 1 for the document stack is on the bottom of the stack and the document sheets are in collated orientation. It is also assumed that the simplex to simplex mode has been chosen. Upon actuation of the copier/finishing system, the bottommost document sheet page 1, will be separated and transported to the platen 14 where dual flash exposure of page 1 is effected. As the document sheet containing page 1 is removed by the belt 60, the second document sheet containing page 2 is immediately transported to the platen 14, as the first document sheet is being removed, thereby eliminating machine pitch loss.

The remaining document sheets are likewise separated from the stack and double exposed for the simplex side of the sheets. The document sheets are, in turn, returned to the tray 61 in the order in which they were originally placed by the simplex transport 70. Such original order will be retained since each document sheet undergoes double inversion by the combined action of the rollers 65 and 71.

In the meantime, as the stack of document sheets are being double exposed, copy sheets are fed from either the main or auxiliary sheet trays 29, 30, respectively. Since the copy sheets are involved in simplex copying, as they leave the fuser device 36, they are immediately transported out of the processor 11 by the transports 42 and 50, since in simplex copying, the deflector 53 would have been actuated to the position shown in full lines in FIG. 1.

In leaving the processor 11 by way of the transport 50, the copy sheets are transported to the finishing station 13 for a binding operation therein. Since the copy sheets will be transported with fused images on the bottom side of the copy sheets and with ascending order of numbering, the sheets will enter the bins 79, 80 in proper collated orientation. In this event, no sheet inversion is necessary. Continuous production of a pre-set reproduction job, or run, is maintained at a resultant rate of two copy sets at a time. As in the embodiment of FIG. 1, for each circulation of a document set, two copy sets are produced thus minimizing document handling stress.

In the alternative, and from a human factors approach, if it is more desirable to condition an operator always to load the document apparatus 12 with document sheets face up, the customary orientation one handles documents, then the document sheets may be initially placed in the tray 61 face up. The programmer for the machine may then be arranged so that upon actuation of the machine, the apparatus 12 will initially slew very quickly the document sheets from the tray, across the platen 14, around the roller 65 down the transport 72 and back into the tray, without exposure. This procedure will invert the document sheets to place them face down for copying, as aforesaid.

In duplex to duplex copying mode, the duplex document sheets are placed in the tray 61 in 1-N orientation, that is, page 1 of sheet one of the document set is on top of the stack and the last page N, of the last sheet is on the bottom of the stack. In the duplex copying mode, the auxiliary tray 30 must be emptied of copy sheets and the machine programmer instructed to inhibit operation of the tray as a supply tray and to condition it for use as a duplex tray.

The bottommost document sheet is fed from the tray 61 and transported to the platen 14 whereat two exposures are made of the bottom side of the bottommost sheet. This sheet is then removed from the platen and transported in an inverted orientation back on top of the stack in the tray 61 by the duplex circulation path 72. The first two copy sheets for these exposures of the bottom side of the bottommost document sheet are fed from the main tray 29 in proper timed sequence, each then having transferred thereto one of the resultant developed toner images, and finally being directed into the auxiliary tray 30 by way of the path involving items 34, 36, 42, 56 and 52. The orientation of these two sheets in the tray 30 is such that a copy corresponding to the bottom side of the bottommost document sheet is on the top side of each of the copy sheets.

As the bottommost document sheet was removed from the platen 14, as aforesaid, the second bottommost document sheet is immediately fed thereon without a pitch loss and a double exposure is made of the bottom side of this document sheet. Corresponding copy sheets are fed from the tray 29 and the resultant copies are conveyed to the tray 30 with the image side on top, as were the first two copy sheets. This sequence continues until all of the document sheets have had their bottom sides copied and returned to the document tray 61 in an inverted orientation. The resultant copy sheets in the auxiliary tray 30, now serving as a duplex tray are twice in number as the document sheets and each copy sheet has its blank side on the bottom.

The document sheets are immediately sequentially fed again from the tray 61 upon completion of exposure of their bottom sides for the commencement of copying of the other side of the document sheets. In this second circulation of the document sheets, the other sides of these sheets are double exposed as were the initially exposed sides and the sheets are returned to the document tray in their original orientation, that is, 1-N. During this second circulation, the copy sheets previously placed in the auxiliary tray are correspondingly bottom fed out of the tray to receive images on the bottom side of each of the copy sheets. Consequently, the two duplicate bottom copy sheets each bearing on their top sides an image of the bottom side of the bottommost document sheet will be fed sequentially to the transfer station for the processor 11 to receive the image corresponding to the top side of the bottommost document sheet. The remaining copy sheets will likewise be transported through the processor 11 to receive images corresponding to the top side of the document sheets all in proper orientation.

The duplex copy sheets are then transported to the finishing station 13, for dual collation and stapling, as aforesaid. During the sequencing of document handling in the apparatus of FIG. 2, pitch loss is minimal since each document sheet may be moved onto the platen 14 as the previous sheet is moved out of the exposure station. A pitch-loss may be experienced between the finish of one circulation and the beginning of another. The copy sheets may be transported in quick succession as is normal operation of the processor 11.

Figure 5:
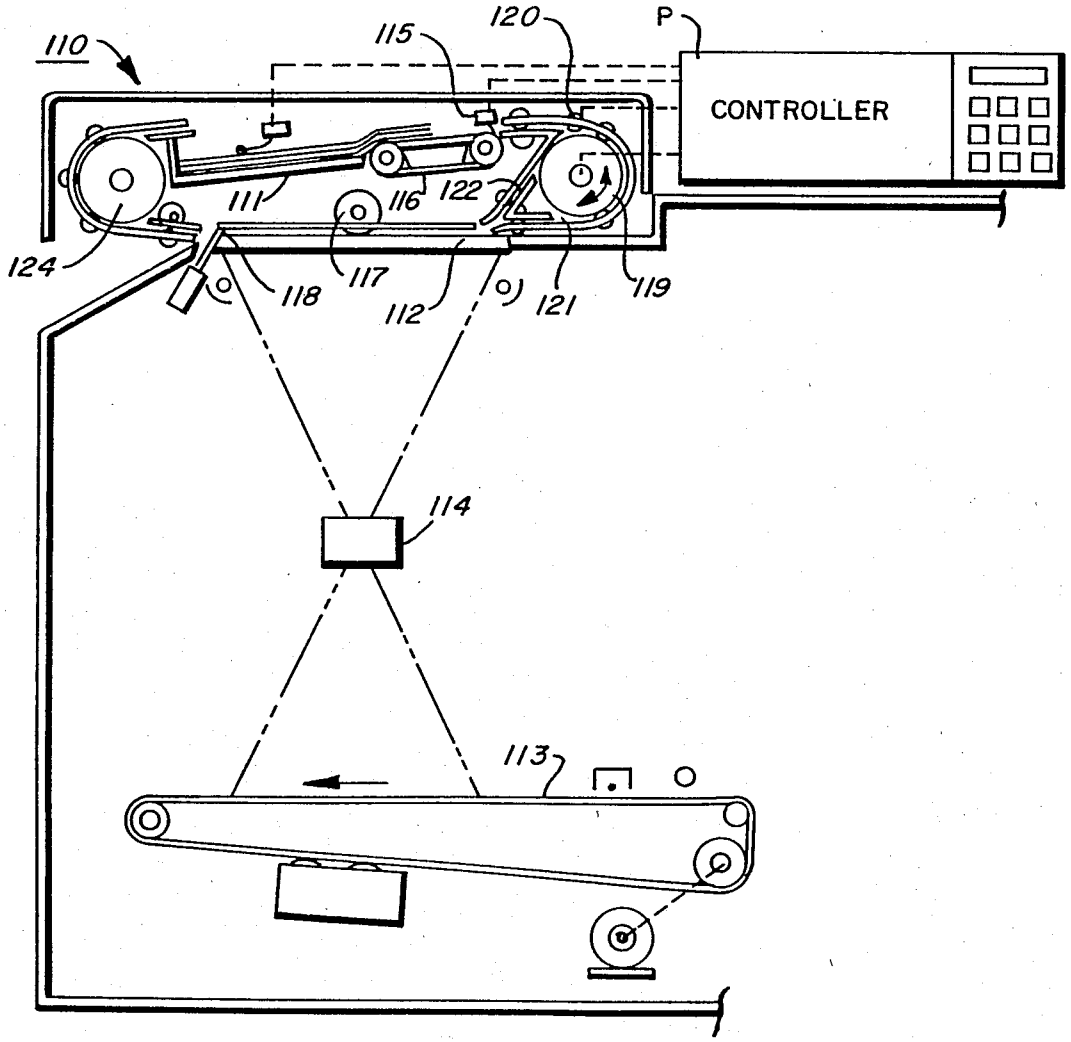
FIG. 5 is another embodiment of a document handling apparatus which may be utilized in the present invention.

Another type of document handling apparatus which may be utilized in the present invention is illustrated in FIG. 5 and indicated by the reference numeral 110. The structural details of this particular document apparatus are the same as those used in the commercial copier labelled 1075 presently being marketed by Xerox Corporation and which are illustrated and described in the above referred to U.S. Pat. No. 4,278,344. As will be described below, the operation of the apparatus 110 has been modified, in accordance with the present invention, relative to the operation involved in the apparatus disclosed in this patent.

In the recirculating document handler 110, individual document sheets are sequentially fed from the bottom of a stack of document sheets placed by the operator face up in normal collated order in the document stacking tray 111. Sheets are fed to the exposure plate 112 to be imaged onto a photoconductive belt 113 by an optical system 114 for the production of copy sheets in the conventional xerographic manner. The document handler 110, as is the case for the document handling apparatus 12, may have conventional switches or other sensors such as 115 for sensing and counting the individual documents fed from the tray, i.e. counting the number of document sheets circulated. The document feeder 110 is adapted to serially or sequentially feed the document sheets which may be various conventional sizes and weights of sheets of paper containing information data to be copied, on one or both sides. A bottom feeder 116 feeds the bottommost document sheet, on demand, through one of two feed paths, to a on-the-platen drive 117 which moves the document sheet into a registration gate 118 over the copier platen.

In the document feeder 110, each document sheet is selectably inverted or not inverted as it is fed from the tray 111 to the imaging station 112. This is accomplished before the document has been copied, by a selectably reversible sheet drive roller 119 and a decision gate 120, in these paths. Each document sheet is fed initially from the tray 111 and around the outside of the roller 119. If it continues around roller 119, it is fed in an inverted orientation through a path 121 onto the platen 112. However, the decision gate 120, in the document path adjacent the entrance to roller 119 and comprising pivotable deflector fingers, may be made operable after the trail edge of the document sheet has passed this gate.

Actuation of the gate 120, together with reversal of the roller 119 causes the further recirculatory movement of the document sheet through a different transport path 122 to the platen for copying. Thus, these two different paths are the first or simplex transport path 121 and the second or duplex transport path 122. The second or duplex transport path 122 effectively has no sheet inversion, but this is accomplished through the reversal of the roller. In this manner, the document sheets only go partially around the roller 119 and then are reversed in direction and fed directly back through the now deflected gate 120 into the duplex path 122 which feeds directly onto the platen 112. Thus, in the duplex path 122, the document sheets arrive at the platen without being inverted from their original orientation in tray 111. For example, if the even sides of duplex document sheets are face down in the tray 111, they will still be face down when they reach the platen 112 for copying, providing the duplex 122 is utilized.

In contrast, the first or simplex transport path 121 transports the documents unidirectionally fully around the roller 119 onto the platen 112. Thus, the orientation on the copying platen of the document sheets fed through the simplex path 121 is inverted from their previous orientation in the tray 111.

It may be seen that the return path of the document sheets to the tray 111 from the platen after they are copied is always the same, and contains one sheet inversion. In using either the simple or the duplex path, the document sheets are fed back around a second, but non-reversing, inverting roller 124, which returns them to the top of the stacking tray 111. Thus, with the selection of the simplex transport path 121, the document sheets are inverted twice around both rollers 119 and 124, and with the selection of the duplex transport path 122, the document sheets are inverted once, referring to the total circulation path from the bottom of the tray 111 back to the top thereof. Therefore, it may be understood that the reversal or non-reversal of the roller 119 and the coordinate actuation or non-actuation of the selector gate 120 therewith during a document set circulation determines whether that set of document sheets will be recirculated with a total of one or two inversions in that circulation.

In either case, since the document sheets can be continuously restacked simultaneously with continuous feeding by the feeder 116, continuous multiple recirculations can be provided for precollation copying. However, with two total path inversions (i.e. utilizing the simplex path 121), the same sides of the document sheets will be exposed in the next and each following circulation, and the document sheets will always be restacked in the tray 111 in their same original orientation. In contrast, with only one total path inversion (using the duplex path 122), the document sheets will be restacked in the tray 111 inverted from their previous orientation. Thus, the apparatus of path 122 is referred to as the inverter because its total circulation path effect is inversion, even though its local effect is actually non-inversion, as described above. Thus, the opposite sides of the document sheets will all be copied in the subsequent circulation.

Further description of the structural features of the apparatus 110 is not necessary to understand and appreciate the present invention. Such structural features are illustrated and described in the above referred to U.S. Pat. No. 4,278,344.

However, as previously described with the document handling apparatus 12 in FIG. 2, the operation of the inverter mechanisms involved in this duplex document inversion, utilizing the duplex sheet reversal path 122, inherently would normally sustain reliability problems if the apparatus 110 must be frequently used for multiple recirculations of a duplex document set. As was described above, the present invention provides a copying/finishing system which minimizes the use of this duplex transport path 122, i.e. minimizes the reversal of the roller 119 and the operation of the gate 120.

In accordance with the present invention, a double flash exposure is made for each side of a document sheer brought to the platen 112 for exposure whether the copying/finishing system is operating in the simplex or the duplex mode.

In the simplex mode, wherein document sheets are in the face up orientation in the tray 111, that is, the bottommost sheet has the highest page number and is face up, and the topmost sheet has page 1 face up, the sheets are fed individually and sequentially around the roller 119, brought to the platen 112 for registration and dual exposures and then returned to the tray 111 by way of the roller 124 in the same orientation as the document sheets were when originally placed therein.

In the cooperating copying process, with the document apparatus 110 working in conjunction with a copy sheet processor similar to the processor 11, duplicate simplex copy sheets are produced for each simplex document sheet so exposed. If the copy sheets leaving the transfer station for the copy processor for the belt 113 have their transferred image side inverted, an inverter 200 (see FIG. 3) must be used in the transport system to the collating trays 79, 80 in order to obtain properly oriented collated copy sets. Details of the copy processor for the apparatus 110 of FIG. 5 are found in the above referred to U.S. Pat. No. 4,278,344.

In producing duplex copy sheets from simplex document sheets placed in the tray 111 in numerical face up orientation, the last document sheet is brought directly to the platen 112 for dual exposure then removed by the roller 124 as the second last document sheet is brought to the platen for dual exposure, and so on. The simplex document sheets are returned to the tray 111 and when all document sheets have been exposed in this manner, the sheets will be in the same numerical order, face up as when placed in the tray, awaiting to be recirculated again. In this mode of operation, the duplex copying arrangement described in relation to FIG. 1 may be utilized to produce two successive or side-by-side duplicate duplex copy sheets, corresponding to the last and second last document sheets and so on. In being transported to the collecting bins 79, 80, the copy sheets will need to be inverted.

In producing duplex copy sheets from duplex document sheets, the intermittent reversal of the roller 119 is utilized. Assuming the last document sheet has an even numbered bottom page and the top side of the sheet is odd numbered, and sheets above the last sheet are also oriented in this manner, as the last sheet is separated from the stack it is carried around the roller 119, as controlled by the machine programmer actuating the deflector gate 120. When the trailing edge of this sheet passes the gate 120, the latter is actuated downwardly and the direction of rotation of the roller 119 is reversed to convey the sheet through the duplex path 122 and onto the platen 112.

In this manner, the even numbered page, which is the highest numbered page in the document stack will be exposed first. After dual exposure, the sheet is reconveyed back through the path 112, and around the roller 119 which has been reversed again in direction. This reversal conveys the sheet upon the platen with the odd or top side of the sheet in position to be double exposed. After this exposure, the sheet s conveyed around the roller 124 and back into the tray 111, above the remaining stack of document sheets, in the same orientation as initially placed. The remaining document sheets in the stack are similarly handled until all of the sheets have been twice exposed on each side.

In using the duplex mode of copying for the arrangement of FIG. 2, an arrangement similar to FIG. 1 for processing copy sheets and temporarily storing copy sheets having only one side copied in a duplex tray may be combined with the document apparatus of FIG. 5.

Figure 6:
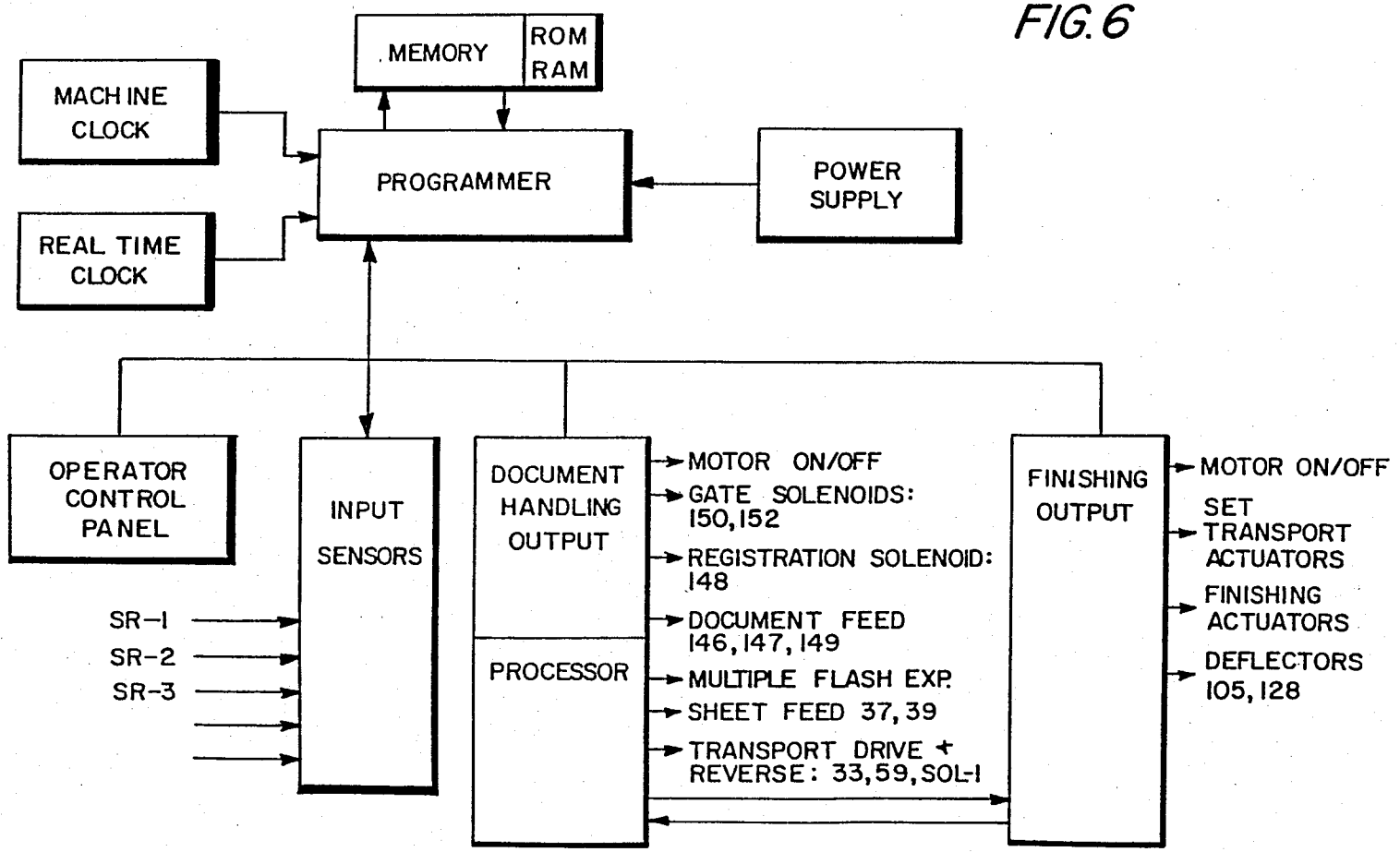
FIG. 6 is a block diagram of the control scheme for the various systems described herein.

The block diagram FIG. 6 illustrates the relationship between the inputs and outputs for document handling, two tray collection and finishing in the foregoing description and the control arrangement therefor. While not shown as being unnecessary, the inputs and outputs for the processor 11 are also interrelated to the control arrangement. The block diagram depicts the cooperating action between the control components of the processor 11, either of the document apparatus 12 and 110, and the finishing apparatus 13.

While not preferred, other examples of automatic, on-line collating copiers/finishers having staplers, stitching, or adhesive binding devices, which may with substantial modification, be utilized with the present invention are disclosed in U.S. Pat. Nos. 4,328,919, 4,134,672 and the "Research Disclosure Journal", Publication Nos. 22733 and 22734, pages 120–134, March 1983. However, revision would necessarily have to be made to provide at least the structural requirements to achieve the present invention. Examples of single pass copying in a processor are disclosed in U.S. Pat. Nos. 3,506,347 and 4,264,183.

Therefore, while the invention has been described in connection with particular arrangements and operations thereof, no limitation is intended thereby except as defined in the following claims.

We claim:

1. In a reproduction system having a copy sheet processor for reproducing information from document sheets onto copy sheets and means for producing the information in the form of an individual light image onto one or both sides of each copy sheet, the improvement including:

means for effecting the production of two successive light images of a side of each document sheet whereby the copy sheet processor produces an output of successive duplicate copy sheets, a pair of sheet collecting trays arranged to receive copy sheets from the processor and to collate the same into sets of copies of different images, means for transporting the copy sheet output of the processor and directing the same to said collecting trays alternately, and a finishing apparatus adapted to receive the collated sets of copy sheets from said collecting trays alternately in timed sequence relative to the light images being reproduced and to bind the sets.

2. In a reproduction system having a document handling apparatus adapted to transport individual document sheets from a supply stack to an exposure platen of a reproduction processor and effecting exposure of each of the document sheets before returning a sheet to the supply stack, and a copy sheet processor adapted to produce copy sheets of the exposed document sheets, the combination of:

a pair of sheet collecting trays arranged to receive the copy sheet output from the processor and to collate the same, means for directing the copy sheet output of the processor to said collecting trays alternately, and a finishing apparatus adapted to receive collated sets of copy sheets of a set of document sheets from said trays alternately and to bind the same.

3. A reproduction system having a copy sheet processor for reproducing information on copy sheets and means for producing the information in the form of an individual light image onto one or both sides of each copy sheet, comprising:

means for producing a train of copy sheets with successive sheets being in groups of two having identical information thereon, means for separating the copy sheets into two sets with one copy sheet from each group being directed into one set and the other copy sheet of each group into the other set, and a finishing apparatus adapted to receive said sets of copy sheets alternately and to bind the sets.

4. In a reproduction system having means for presetting a reproduction run, a document handling apparatus adapted to transport individual document sheets from a supply stack to an exposure platen of a reproduction processor and effecting exposure of each of the document sheets before returning a sheet to the supply stack, and a copy sheet processor adapted to produce copy sheets of the exposed document sheets, the combination of:

a pair of sheet collecting trays arranged to receive the copy sheet output from the processor and to collate the same, means for directing the copy sheet output of the processor to each of said collecting trays alternately, a finishing mechanism adapted to receive collated sets of copy sheets of a set of document sheets from said trays alternately and to bind the same, and means for transporting a copy set from each of said trays to said finishing mechanism alternately in repetitive operation until the reproduction run has been completed.

5. The reproduction system of claim 4 wherein said means for transporting includes a set transport associated with each of said trays and a drive means actuable on each set transport individually and alternately.

6. In a reproduction system having a copy sheet processor for reproducing information from document sheets onto copy sheets and means for producing the information in the form of an individual light image onto one or both sides of each copy sheet, the improvement including:

means for efffecting the production of multi-successive light images of a side of each document sheet whereby the copy sheet processor produces an output of successive duplicate copy sheets of each document sheet, sheet collecting trays arranged to receive the processed copy sheets wherein each tray receives one of the duplicate sheets for each document sheet and to collate the same into sets of copies of different images, and a finishing apparatus adapted to bind the collated sets of copy sheets from said collecting trays, said finishing apparatus including a set transport for each of said trays and a binding device arranged for cooperative action with both of said set transports.

7. In a reproduction system having a document handling apparatus adapted to transport individual document sheets from a supply stack to an exposure platen of a reproduction processor and effecting exposure of each of the document sheets before returning a sheet to the supply stack, and a copy sheet processor adapted to produce copy sheets of the exposed document sheets, the combination of:

sheet collecting trays arranged to receive the processed copy sheet output wherein each tray receives one of the copy sheets for each document sheet and to collate the same, means for directing the copy sheet output of the processor to said collecting trays, and a finishing apparatus adapted to receive collated sets of copy sheets of a set of document sheets from said tray and to bind the same, said finishing apparatus including a binding device and a set transport for each of said trays arranged for transporting collated copy sets successively from said trays to said binding device for binding thereby.

8. A reproduction system comprising:

a document handling apparatus adapted to transport individual documents sheets from a supply stack to an exposure platen and effecting two exposures of one side of each document sheet and returning the same to the stack, a copy sheet processor having means for producing the information on said one side of each document sheet onto one side of two successive copy sheets, collating means arranged to receive the copy sheets from the processor and to collate the same into two copy sets alternately, each set being a reproduction of the document sheets in the document stack, and a finishing apparatus adapted to receive said copy sets alternately and to bind the sets.

9. The method of producing bound sets of double-sided copy sheets of a set of double-sided document sheets arranged in top to bottom numerical order in a stack, comprising the steps of:

(a) separating the bottom document sheet of the stack, and presenting the bottom side of the same to an exposure position for an electrostatographic printing system and exposing said bottom side two times;

(b) removing said bottom document sheet from said exposure position and transporting the same onto the top of the stack with the top side thereof facing downwardly;

(c) repeating steps (a) and (b) for all of the remaining document sheets in the stack;

(d) processing copy sheets containing the information on the bottom side of the document sheets and collecting the same in groups of two;

(e) returning the bottom document sheet to the exposure position with the top side thereof at the exposure position and exposing the top side two times;

(f) removing the bottom document sheet from the exposure position and transporting the same onto the top of the stack with the bottom side thereof facing downwardly;

(g) repeating steps (e) and (f) for all of the remaining document sheets;

(h) processing the collected copy sheets containing information on the top side of the document sheets;

(i) collating the copy sheets into sets alternately into each of at least two collecting trays; and (j) transporting the completed collated sets of copy sheets from said trays to a binding apparatus alternately to be bound thereby.

10. In a reproduction system having a copy sheet processor for reproducing information from a stack of document sheets onto copy sheets and means for producing the information in the form of an individual light image onto one or both sides of each copy sheet, the improvement including:

means for effecting the production of two successive light images of a first side of the document sheets in a first handling thereof and then effecting the production of two successive light images of the second side of the document sheets in a second handling thereof, means associated with the copy processor for effecting the processing of copy sheets in accordance with the light image of the first side of the document sheets during said first handling thereof, collecting the copy sheets until said first handling is completed and effecting the processing of the copy sheets in accordance with the light images of the second side of the document sheets during said second handling thereof, a pair of sheet collecting trays arranged to collate the copy sheets into copy sets as reproduction of the stack of document sheets, means for transporting the copy sheet output of the processor and directing the same to said collecting trays alternately, and a finishing apparatus adapted to receive the collated sets of copy sheets from said collecting trays alternately in timed sequence relative to the light images being reproduced and to bind the sets.

11. The method of producing bound sets of copy sheets of a set of document sheets in simplex to simplex mode of copying, comprising the steps of:

plurally circulating the document sheets from a document stack to an exposure station of an electrostatographic printing system for exposure thereof and returning the sheets to the stack in a predetermined number of set-copying circulations determined by a preset reproduction run, exposing the document sheets in said circulations when at said exposure station, processing through the printing system the resultant copy sheets containing the information on the document sheets, and collating the copy sheets into sets and binding the same at a rate wherein said predetermined number of set-copying circulations is equal to one-half of the number of bound copy sets produced.

12. In a reproduction system having means for presetting a reproduction run, a document handling apparatus adapted to transport individual document sheets from a supply stack to an exposure platen of a reproduction processor and effecting exposure of each of the document sheets before returning a sheet to the supply stack, and a copy sheet processor adapted to produce copy sheets of the exposed document sheets, the combination of:

a pair of sheet collecting trays arranged to receive the copy sheet output from the processor and to collate the same, means for directing the copy sheet output of the processor to each of said collecting trays alternately, a finishing mechanism adapted to receive collated sets of copy sheets of a set of document sheets from said trays alternately and to bind the same, and means for transporting a copy set from each of said trays to said finishing mechanism alternately in repetitive operation until the reproduction run has been completed, said means for transporting includes a set transport associated with each of said trays and a drive means actuable on each set transport individually and alternately.

* * * * *